US005797301A

United States Patent [19]

Huenke

[11] Patent Number: 5,797,301

[45] Date of Patent: Aug. 25, 1998

[54] WHEEL HUB HAND WRENCH

[76] Inventor: Mark Huenke, P.O. Box 858, Liberty, Utah 84310

[21] Appl. No.: 717,542

[22] Filed: Jun. 23, 1996

[51] Int. Cl.[6] ..... B25B 13/48

[52] U.S. Cl. ..... 81/176.15; 81/180.1; 81/461; 81/438; 131/238; 7/138

[58] Field of Search ..... 81/176.1, 176.15, 81/176.2, 124.2, 461, 437–439, 180.1, 185.1, 184, 177.85; 7/138, 170, 165; 131/238

[56] References Cited

U.S. PATENT DOCUMENTS

| | | | |
|---|---|---|---|
| D. 212,065 | 8/1968 | Stohl | 131/238 X |
| 3,073,206 | 1/1963 | Rudolph | 81/176.15 X |
| 4,027,572 | 6/1977 | Burge | 81/176.15 X |
| 4,061,058 | 12/1977 | Douglas | 81/176.15 |
| 4,738,167 | 4/1988 | Ball | 81/124.2 |
| 5,029,771 | 7/1991 | Ranoia | 81/176.15 X |
| 5,287,775 | 2/1994 | Moore | 81/177.1 X |
| 5,361,656 | 11/1994 | Starr | 81/180.1 |

*Primary Examiner*—D. S. Meislin
*Attorney, Agent, or Firm*—Marcus G. Theodore

[57] ABSTRACT

A circular hand held wheel hub wrench having a hand grip with dual fork prong structure attached thereto for engaging the turn bar or wheel hub turn bar extensions of four wheel axle drive exterior engaged wheel hubs having two opposed finger depressions on both sides of a turn bar to allow the fork prong structure to be inserted therein to grasp the turn bar or wheel hub turn bar extensions to turn the wheel hub to engage and disengage a wheel axle drive as the hand grip is turned.

5 Claims, 2 Drawing Sheets

WHEEL HUB HAND WRENCH

BACKGROUND OF THE INVENTION

1. Field

This invention pertains to hand wrenches. More particularly, it pertains to a hand wrench adapted to lock and unlock exterior four wheel drive wheel hubs.

2. Background of the Invention

Various hand, lug, and speed wrenches are known. These tools are adapted to rotatably drive screws, bolts, nuts and the like. These prior art tools include common screwdrivers, wrenches, nut drivers, adjustable wrenches, socket wrenches, etc. An example of a socket wrench is Main, U.S. Pat. No. 5,005,448 which discloses a speed wrench and hand grip combination particularly adapted to drive lugs. These wrenches are not specifically adapted to loosen and tighten exterior activated wheel hubs of four wheel drive trucks, multi-purpose, and all terrain vehicles. Thus there remains a need for a tool which can quickly tighten and loosen the exterior wheel hubs of four wheel drive vehicles to engage and disengage the axle wheel drive.

SUMMARY OF THE INVENTION

Many four wheel drive trucks, all terrain, and multi-purpose vehicles employ exterior wheel hubs which must be turned to engage and disengage an axle wheel drive. These exterior wheel hubs generally have two semi-circular finger depressions along a turn bar in the wheel hub which must be grasped for turning. Other extended exterior hubs may include turn bar extensions which must also be grasped and turned for activation of the axle wheel drive. In inclement weather, oftentimes mud and debris make the turn bars and turn bar extensions difficult to grasp. In addition, during long periods of non-use, grime build-up makes these turn bar and turn bar extensions difficult to finger turn.

The invention comprises a wheel hub wrench with prongs which insert within the finger depressions on both sides of a turn bar or turn bar extension to grasp the same to turn the wheel hub to engage and disengage the wheel axle drive. Specifically, it comprises a hand grip having corresponding extending prong structure to removable insert within the finger depressions to engage the turn bar or turn bar extensions of exterior engaged wheel hubs to enable a user to apply more torque when hand turning the wheel hub turn bars. Preferably, the hand grip is structured as a circular disc surrounding centrally located extending prongs. The circular disc is of sufficient diameter to be gripped along its perimeter by the fingers of the hand to provide added torque when the prongs engage the turn bar or turn bar extension. In one preferred embodiment, the circular perimeter has finger depressions to provide a better grip for the fingers to grasp and turn the hand grip.

The wheel hub wrench is constructed of a strong, light weight nylon or plastic material which has sufficient strength to turn the turn bar or turn bar extension, but will not mar the wheel hub when turned. Preferably, it is molded in one piece to minimize cost. However, the prongs may be separately constructed and separately fitted to the hand grip, if desired, to enable the prongs to be separately replaced, if accidentally broken.

The wheel hub of a typical externally activated four wheel axle drive vehicle has two opposed semi-circular finger depressions on both sides of a turn bar. These finger depressions allow the fingers of a hand to be inserted therein to grasp the turn bar to turn the wheel hub to engage and disengage a wheel axle drive. For this type of wheel hub configuration, the invention comprises a similar shaped circular disc described above. Attached to the circular disc are two centrally located extended prongs adapted to removable insert within the semi-circular finger depressions to removably engage the turn bar to enable a user to apply added torque to the turn bar to hand turn the wheel hub.

In another preferred embodiment, the prongs have a depression therebetween to enable the hub wrench to be used as an ashtray when the wheel hub wrench is turned upside down and placed on a support surface. In this preferred embodiment, the top of the wheel hub wrench has a gripping surface to adhere to a support surface, such as a dashboard, to prevent slippage. This gripping surface covered top may also be colored or patterned to suit the preference of a user, or may include advertising.

It is also contemplated that the wheel hub wrench may include an adaptor to convert it into a socket wrench or engage various types of wheel hub turn bar extensions. This is accomplished by structuring a first end of the adaptor to removably secure to the prongs of the wheel hub wrench. A second end of the adaptor has a socket attachment end which removably attaches to conventional sockets for use as a lug wrench or to removably grasp the wheel hub extensions. Thus adapted, the wheel hub wrench provides a versatile multi-purpose tool which also quickly locks and unlocks manually activated exterior wheel hubs of direct drive vehicles.

DESCRIPTION OF THE ILLUSTRATED EMBODIMENTS

Figure 1:
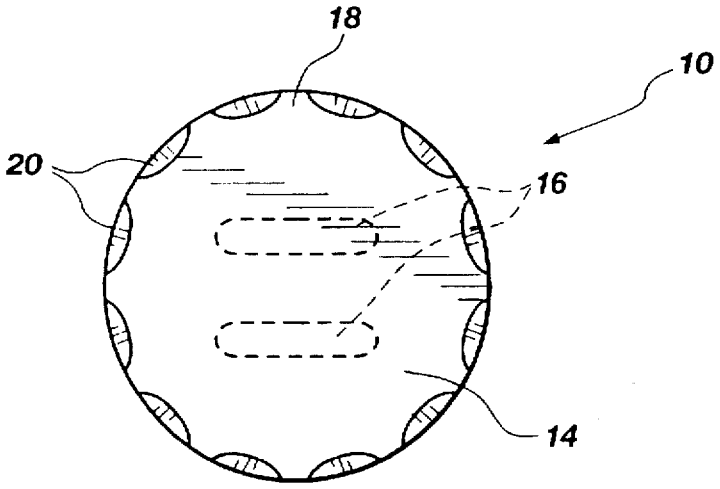
FIG. 1 illustrates a top view of one preferred embodiment of the invention.

FIG. 1 illustrates a top view of one preferred embodiment of the invention 10. The bottom 12 of the hand grip 14 has two corresponding extending prongs 16. The hand grip 14 is structured as a circular disc surrounding the centrally located and extending prongs 16. The circular perimeter 18 of the hand grip 14 has a diameter sized to be gripped and turned by the fingers of the hand to provide added torque.

The preferred embodiment shown has a circular diameter of approximately 3½ inches. This hand grip 14 is approximately ¾ to 1 inch thick, and has finger depressions 20 to enable the fingers of the hand to fit therein to provide a better grip.

Figure 2:
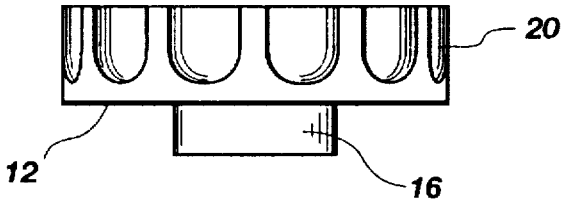
FIG. 2 illustrates a side view of the embodiment shown in FIG. 1.

FIG. 2 illustrates a side view of the embodiment shown in FIG. 1 showing how the extended prongs 16 extend approximately ¾ of an inch beneath the bottom 12 of the hand grip 14.

Figure 3:
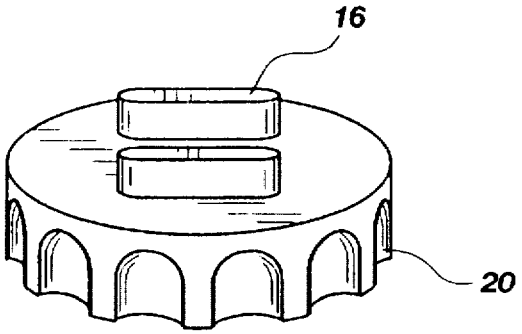
FIG. 3 illustrates a perspective view of the embodiment of the invention shown in FIG. 1.

FIG. 3 illustrates a perspective view of the embodiment of the invention shown in FIG. 1 formed as a single piece of blow molded nylon or plastic which is strong enough for the prongs 16 to turn a wheel hub, but will not mar the wheel hub when turned.

Figure 4:
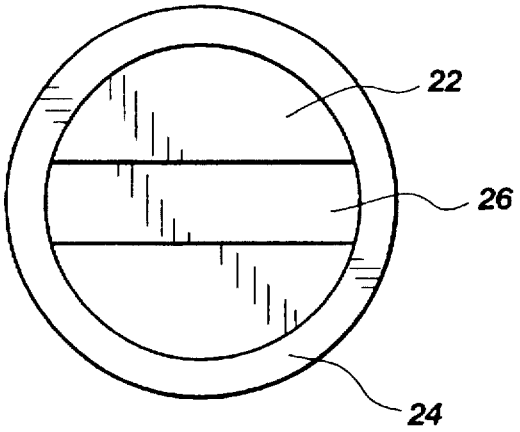
FIG. 4 is a top view of a typical exterior manually activated wheel hub of a direct drive vehicle.

The hand grip 14 is thus structured such that its extended prongs 16 removable insert within the finger depressions 22 of an exterior engaged wheel hub 24 shown in FIG. 4. These exterior engaged wheel hubs 24 may be extended, but generally have two opposed semi-circular finger depressions 22 on both sides of a turn bar 26 to allow the fingers of a hand to be inserted therein to grasp the turn bar. The hand grip 14 prongs 16 are inserted within the finger depressions 22 to turn the turn bar 26 to engage and disengage a wheel axle drive. The hand grip 14 thus enables a user to hand turn the wheel hub with more torque.

Figure 5:
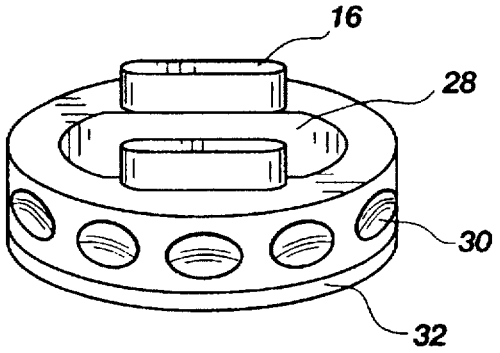
FIG. 5 is a perspective view of another preferred embodiment of the invention.

FIG. 5 is a perspective view of another preferred embodiment of the invention. The bottom 12 defines an ash receptacle 28 located between the prongs 16 for use as an ashtray. The top 30 is covered with a rubber coating 32 which prevents the ash tray adapted hand grip 14 from slipping on a support surface.

Figure 6:
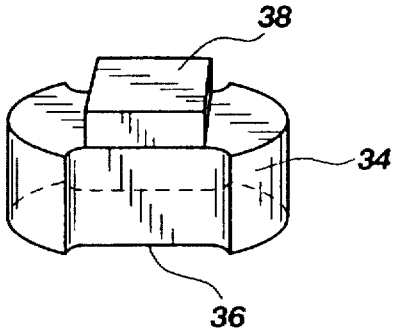
FIG. 6 is a perspective view of a socket adaptor.

FIG. 6 is a perspective view of a socket adaptor 34 for the wheel hub wrench 10. One end of the adaptor 34 has slots 36 which removably fit between and secure the adaptor 34 about the prongs 16. The adaptor 34 has a second square socket end 38 structured to removably secure to conventional sockets to convert the wheel hub wrench 10 into a socket wrench.

Although this specification has made reference to the illustrated embodiments, it is not intended to restrict the scope of the appended claims. The claims themselves recite those features deemed essential to the invention

I claim:

1. A wheel hub wrench for four wheel axle drive exterior engaged wheel hubs having two opposed semi-circular finger depressions opposite a turn bar to allow the fingers of a hand to be inserted therein to grasp the turn bar to turn the wheel hub to engage and disengage a wheel axle drive, comprising:

a circular disc shaped hand grip having a perimeter sized to be grasped by the fingers of a hand, and defining finger depressions to provide a better grip, and two centrally located corresponding extending opposed prongs structured to removably insert within the finger depressions and engage the turn bar of the exterior engaged wheel hubs to enable a user to apply added torque to the turn bar to hand turn the wheel hub, and a universal socket adapter with sides defining slots structured for engagement with the prongs of the handgrip, and a universal square end adapted to removably secure to sockets.

2. A wheel hub wrench according to claim 1, wherein the bottom of the circular disc defines an ash receptacle depression located between the prongs, and the top of the circular disc is covered with a non-slip covering.

3. A wheel hub wrench according to claim 2, wherein the non-slip covering of the top of the hand grip is colored and patterned.

4. A wheel hub wrench according to claim 1, wherein the bottom of the circular disc defines an ash receptacle depression located between the prongs, and the top of the circular disc is covered with a non-slip covering.

5. A wheel hub wrench according to claim 1, wherein the universal socket is structured to removably secure the adapter to the wrench.

* * * * *